US011613936B2

(12) United States Patent
Dziekonski

(10) Patent No.: US 11,613,936 B2
(45) Date of Patent: Mar. 28, 2023

(54) MODULAR TUBULAR PRODUCT FOR WELL APPLICATIONS

(71) Applicant: Mitchell Z. Dziekonski, Stafford, TX (US)

(72) Inventor: Mitchell Z. Dziekonski, Stafford, TX (US)

( * ) Notice: Subject to any disclaimer, the term of this patent is extended or adjusted under 35 U.S.C. 154(b) by 95 days.

(21) Appl. No.: 15/885,005

(22) Filed: Jan. 31, 2018

(65) Prior Publication Data

US 2018/0223604 A1 Aug. 9, 2018

Related U.S. Application Data

(60) Provisional application No. 62/455,222, filed on Feb. 6, 2017.

(51) Int. Cl.
*E21B 17/042* (2006.01)
*E21B 19/16* (2006.01)

(52) U.S. Cl.
CPC ..... *E21B 17/042* (2013.01); *E21B 19/16* (2013.01)

(58) Field of Classification Search
None
See application file for complete search history.

(56) References Cited

U.S. PATENT DOCUMENTS 2,117,357 A * 5/1938 Peterson ..... E21B 17/042 285/39
3,126,214 A * 3/1964 Wong ..... F16L 13/004 285/329
3,326,581 A * 6/1967 Wong ..... E21B 17/00 285/333
3,493,061 A * 2/1970 Gyongyosi ..... E21B 19/146 175/85
3,667,784 A 6/1972 Hokanson et al.
4,240,652 A * 12/1980 Wong ..... F16L 13/007 285/91
5,148,876 A 9/1992 Wilson
6,395,723 B2 * 5/2002 Kagan ..... A61K 31/57 552/557
2009/0194337 A1 8/2009 Indrupskiy et al.
2016/0130885 A1 5/2016 Liu et al.
2017/0334528 A1 * 11/2017 Roodenburg ..... E21B 19/155

OTHER PUBLICATIONS

International Search Report and Written Opinion for PCT/US18/16899 dated Apr. 26, 2018 (9 pages).

* cited by examiner

*Primary Examiner* — Matthew Troutman
*Assistant Examiner* — Douglas S Wood
(74) *Attorney, Agent, or Firm* — Fletcher Yoder, P.C.

(57) ABSTRACT

A modular tubular system is assembled of a tool handling section and a tubular section. The tool handling section may be made of a material that is suitable for handling by conventional tubular handling tools, such as conventional steel. The tubular section may be made of a different material with desired properties for special applications in a well, such as aluminum, titanium, nickel, or stainless steel alloys, or composite materials. A joint, such as a pin tool joint may be assembled on an end of the tubular section opposite the tool handling section to allow the modular system to be joined with mating tubular products, both conventional and modular. The resulting system provides advantages of the different material of the tubular section while allowing for more robust handling and ease of integration via the handling section.

17 Claims, 2 Drawing Sheets

MODULAR TUBULAR PRODUCT FOR WELL APPLICATIONS

CROSS-REFERENCE TO RELATED APPLICATIONS

This application claims priority from and the benefit of U.S. Provisional Application Ser. No. 62/455,222, entitled "Modular Tubular Product for Well Applications," filed Feb. 6, 2017, which is hereby incorporated by reference in its entirety.

BACKGROUND

The present disclosure relates generally to tubular products used in well applications, such as for drilling, producing, offshore intervention, and servicing of oil and gas wells. More particularly, the disclosure relates to a modular product comprising a tubular section and a tool handling section.

Technologies used in exploration and production of subterranean deposits have been greatly refined over past decades. All equipment used for wells in such applications involve tubular products which can traverse water depths, subterranean formations, and that ultimately access subterranean horizons of interest. These horizons may include locations where products are found that have commercial value, such as oil and gas deposits. In conventional systems, tubular products such as drillpipe, casing, offshore risers, subsea intervention, and so forth are assembled at the Earth's surface or on a floating vessel or platform, and run into a well. In most cases, these tubular products are made of steel that is produced and utilized in standard lengths with standard coupling ends that can be readily threaded together to form an extended tubular string.

Alternative products exist for these conventional tubular sections, including tubular sections made of aluminum, titanium, nickel, and stainless steel alloys, composite materials, and so forth. In handling certain of these alternative materials, however, handling equipment, particularly tools used to grasp and lift the tubular sections may damage the sections. That is, such tools are generally suitable for steel tubular products, but may not be designed to grasp or move other materials without the potential for gouging, scoring, deformation, or other damage. This is particularly the case for aluminum and titanium alloys and composite tubular sections.

There is a need, therefore, for tubular products that provide an alternative to conventional steel products but that can be utilized with existing tooling for manipulating the products during manufacturing, transportation, loading, and use at a well site.

BRIEF DESCRIPTION

In accordance with one aspect of the disclosure, a modular tubular system comprises a tool handling section made of a first material suitable for handling with standard tubular handling tools, and a tubular section assembled with the tool handling section and made of a second material not suitable for handling with the standard tubular handling tools.

The disclosure also provides a modular tubular system comprising a tubular section made of a material not suitable for handling with standard tubular handling tools, a tool handling section assembled on first end of the tubular section and made of a material different from that of the tubular section and suitable for handling with standard tubular handling tools, and a tool joint assembled on a second end of the tubular section and made of a material different from that of the tubular section.

Further, the disclosure provides a modular tubular system comprising a tubular section made of an aluminum alloy or a composite material, titanium, a tool handling section assembled on first end of the tubular section and made of a steel or a non-magnetic material suitable for handling with standard tubular handling tools, and a joint assembled on a second end of the tubular section and made of steel.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
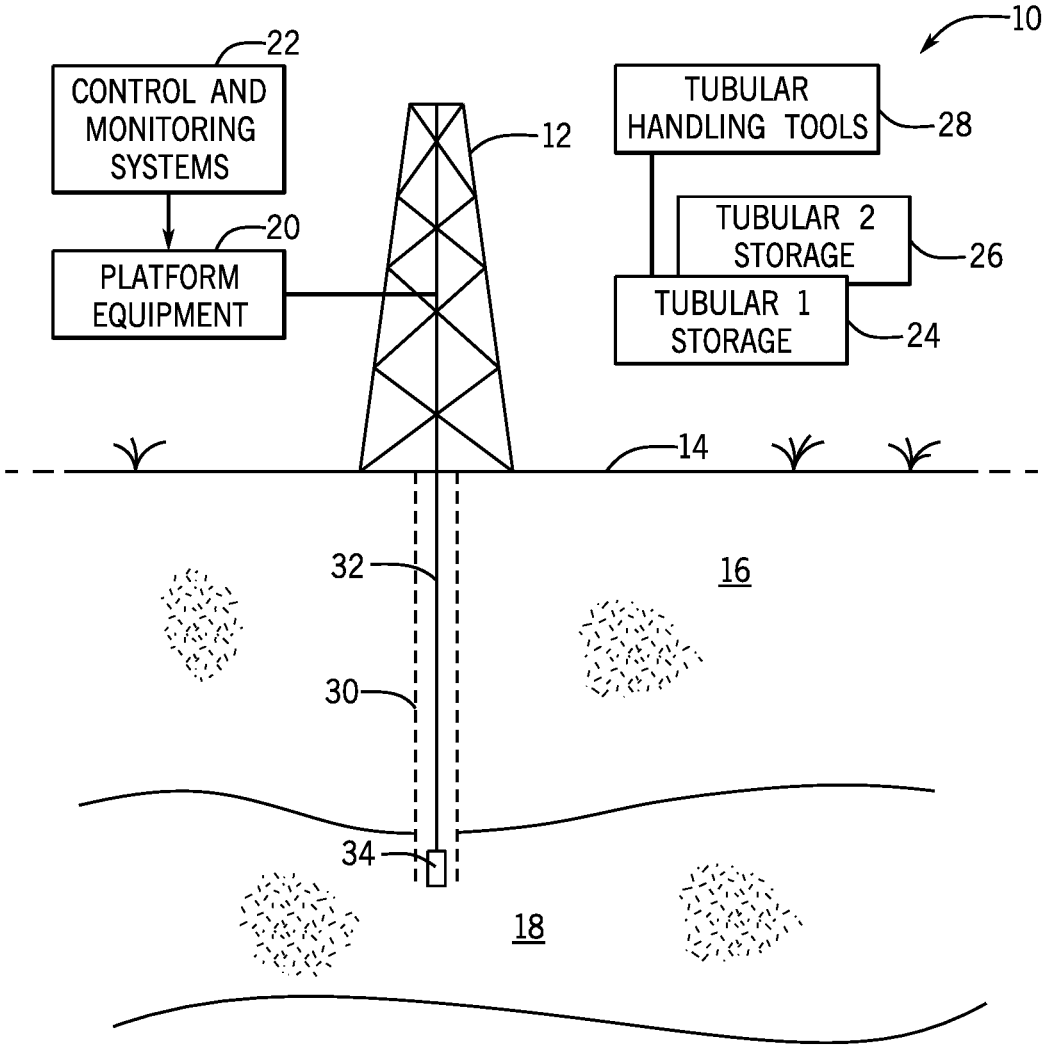
FIG. 1 is a diagrammatical representation of an example installation for drilling, completing, or servicing a well in accordance with the present techniques.

Turning now to the drawings, and referring first to FIG. 1, a well system is illustrated and designated generally by the reference numeral 10. The system is illustrated as an onshore operation located on the earth's surface 14 although the present techniques are not limited to such operations, but may be used in offshore applications, in which the drilling and service equipment and systems described would be located on a vessel or platform, and the well would be located below a body of water. In FIG. 1, the underlying ground or earth is illustrated below the surface such that well equipment is positioned near or over one or more wells. One or more subterranean horizons 16 are traversed by the well, which ultimately leads to one or more horizons of interest 18. The well and associated equipment permit accessing and extracting hydrocarbons located in the horizons of interest, depending upon the purpose of the well. In many applications, the horizons will hold minerals that will ultimately be produced from the well, such as oil and/or gas. The well equipment may be used for any operation on the well, such as drilling, completion, workover, and so forth. In many operations the installation may be temporarily located at the well site, and additional components may be provided.

In the simplified illustration of FIG. 1, equipment is very generally shown, but it will be understood by those skilled in the art that this equipment is conventional and is found in some form in all such operations. For example, a derrick 12 allows for various tools, instruments and tubular strings to be assembled and lowered into the well, traversing both the horizons 16 and the particular horizons of interest 18. Surface equipment 20 will typically include drawworks, a rotary table, generators, instrumentations, and so forth. Control and monitoring systems 22 allow for monitoring all aspects of drilling, completion, workover or any other operations performed, as well as well conditions, such as pressures, flow rates, depths, rates of penetration, and so forth.

In accordance with the present disclosure, many different tubular stocks are provided and used by the operation, and these may be stored on any suitable racks or other storage locations. In FIG. 1 a first of these is designated tubular 1 storage 24, and the second is designated tubular 2 storage 26. As will be appreciated by those skilled in the art, such tubular products may comprise lengths of pipe with connectors at each end to allow for extended strings to be assembled, typically by threading one into the other. The different tubular stocks are used here to allow the operation to balance the technical qualities and performance possibilities of each against their costs. That is, one material may be selected for its relative strength but lower cost (e.g., steel), while the other is selected based upon its corrosion resistance, and/or lower density and modulus, lessening the strain on the drilling equipment, even if specialized equipment is needed for proper installation or it is more costly than the first material. In presently contemplated embodiments, this alternative tubular stock may comprise modular tubular products including sections made of aluminum alloys, for example, but possibly also certain titanium alloys, or composite materials. As discussed below, the operation judiciously selected which material to use based upon the nature of the well, the well position and geology, and the relative need or desire for the alternative modular tubular sections.

Also shown in FIG. 1 are tubular handling tools 28 which may include tongs, slips, bowls, inserts, or specialized equipment for grasping, holding, raising, moving, lowering, and manipulating the tubular products for assembly (e.g., by threading them end-to-end). As discussed below, the modular tubular products in accordance with this disclosure may include a special handling section that can be grasped by the handing tools with reduced risk of damage to the tubular sections of the products. When assembled, the connected tubular sections, which may include many different tubular products, are inserted into the well bore 30 in the form of a continuous tubular string 32. Various tools 34 may be associated with the tubular string, such as at its lower end. Many such tools may be used depending upon the nature of the well and the stage at which it is being worked, such as drill bits, inspection tools, perforating tools, instrumentation, and so forth.

Figure 2:
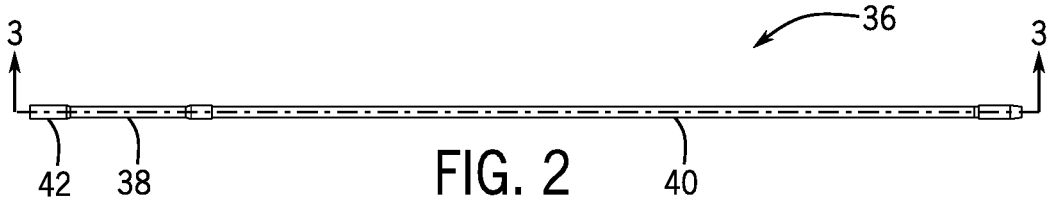
FIG. 2 is an elevational view of a modular tubular section in accordance with the present techniques.
Figure 3:
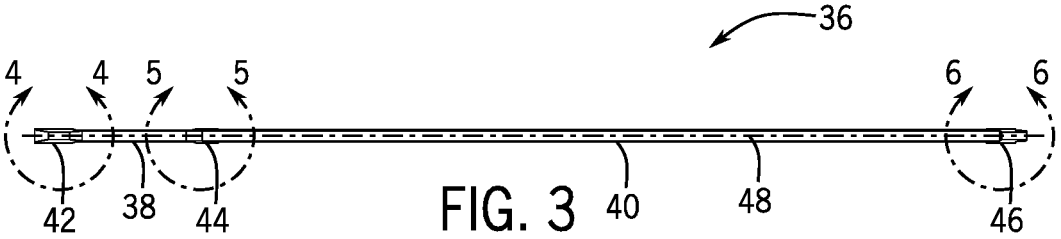
FIG. 3 is a sectional view of the modular tubular section of FIG. 2.

FIGS. 2 and 3 illustrate an example modular tubular section that may be used in well applications of the type illustrated in FIG. 1. The modular section 36 generally comprises a handling section 38 and a tubular section 40. The handling section 38 is designed to interface with conventional handling tools, such as those used with steel tubular products. The handling section may be made of any suitable material, particularly materials that will not be easily damaged by the handling tools. The modular section, over most of its length, will comprise the tubular section 40 which may be made of a different material, such as aluminum, titanium, nickel, and stainless steel alloys, composite materials, and so forth. Such materials may have unique benefits in well applications, including corrosion resistance and/or lighter weight, flexibility, ease of shearing, non-magnetic properties, and so forth. However, because such materials may be more easily damaged by handling tools, the handling section is provided so that, in most applications, only the handling section will need to be grasped or manipulated by standard handling tools.

As shown in FIGS. 2 and 3, at one end of the handling section a box tool joint 42 is provided. A service connection 44 is provided at a location where the handling section 38 meets the tubular section 40. As discussed below, this service connection allows the handling section and tubular section to be joined to one another, such as by a threading engagement. At an opposite end of the tubular section 36 a pin tool joint 46 is provided. It should be noted that variations on the particular arrangement shown may be readily envisaged and implemented. For example, a handling section may be provided at other locations, including at the opposite end of the tubular section shown, at both ends, or at a location between the ends. Other types of connections may also be used, although conventional box tool joints and pin tool joints may allow for ease of interfacing the modular section with conventional tubular sections.

Figure 4:
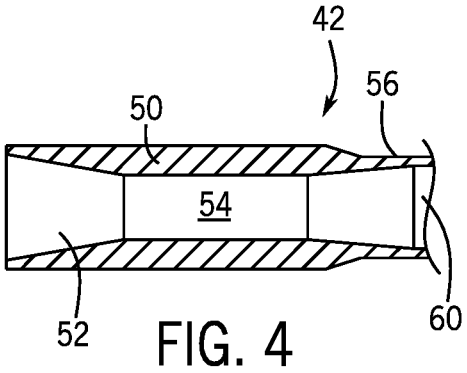
FIGS. 4, 5 and 6 are sectional details of the modular tubular section of FIG. 2.
Figure 5:
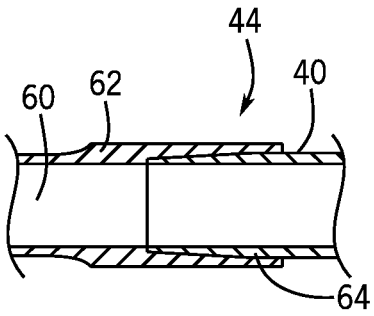
Figure 6:
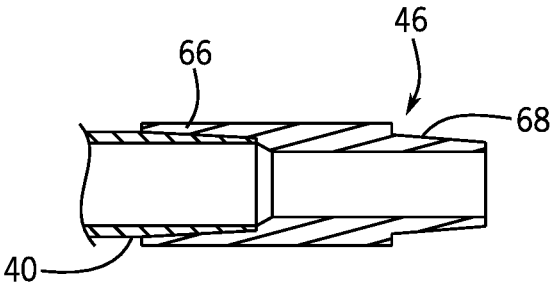

FIG. 4 illustrates an example of the box tool joint 42 of the handling section 38. As noted, this section may be made of a material that is less susceptible to damage by handling tools, such as conventional steel used for existing tubulars. A body 50 of the joint has a female threaded end 52 and a central section 54 of reduced inner diameter. At a side opposite the threaded end, the joint has a neck section 56 of reduced outer diameter forming a handling tube 60. It is generally at this reduced diameter handling tube 60 that the handling tools will grasp and manipulate the entire modular tubular product. The opposite end of the handling section 38 is illustrated in FIG. 5. Here, the service connection 44 is formed at the end of the handling tube 60. To accommodate joining the handling section to the tubular section 40, an enlarged end region 62 is formed that has a threaded internal connection 64. This threaded connection is coupled via mechanical thread to the tubular section 40. From this point, the tubular section 40 extends over the majority of the length of the assembled modular tubular product. As shown in FIG. 6, at an opposite end of the tubular section, a pin tool joint 46 may include a connector that is coupled via mechanical thread on the tubular section 40. In the illustrated embodiment, for example, the pin tool joint 46 has a female threaded portion 66 that is engaged with a threaded end of the tubular section. The joint then has a threaded male end 68 designed to receive or to be threaded into a mating tubular section, which may be a conventional tubular section (e.g., steel), or another assembled modular tubular product. The connector may be made, here again, of any suitable material, but in a presently contemplated embodiment is made of a conventional steel.

Figure 7:
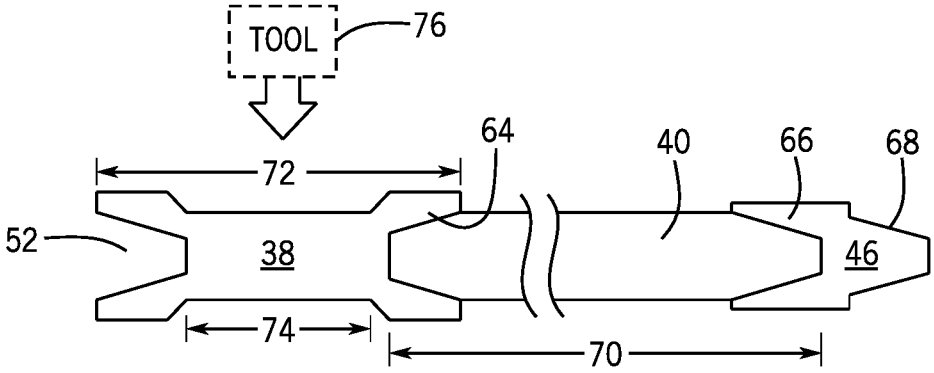
FIG. 7 is a diagrammatical view of the assembled modular tubular section illustrating how it might interface with handling tools.

FIG. 7 is a diagrammatical representation of the assembled modular tubular product illustrating the handling section 38 coupled via mechanical thread to the tubular section 40, and the pin tool joint 46, in turn, coupled via mechanical thread to the opposite end of the tubular section. Again, in the illustrated embodiment, the handling section 38 has a box tool joint 42 (although this could be some other connection, including a pin tool joint). A generally central handling tube 60 extends between this joint and the service connection 44. Then the majority of the modular tubular system comprises the tubular section 40. In this embodiment, a pin tool joint 45 is threaded to the tubular section (although again this could be some other connection, including a box tool joint).

In this embodiment, the tubular section 40 has a nominal length 70 of approximately 290-470 inches, while the handling section 38 has a nominal length 72 of between 25 and 100 inches, based on the application, however, lengths can be modified to suit. The overall length of the assembled modular tubular system is then, approximately 360 to 540 inches. As a result, the tubular section 40 comprises approximately 80-90% percent of the overall length of the assembled system. It is contemplated that the overall length of the tubular system may be selected to be between 360 and 540 inches, to facilitate handling, storage and transport by conventional equipment. Moreover, the outer diameters of the tool joints may be, for example, between 5 inches and 10 inches, with inner diameters between 2.75 inches and 7 inches. Further, to permit handling with conventional handling tools (indicated by reference numeral 76 in FIG. 7), the length 74 of the central reduced diameter tube 60 (see FIGS. 4 and 5) of handling section 38 may be at least approximately 20 to 70 inches.

Regarding the materials of the system, as noted, the handling section 38 may be made of a conventional material suitable for manipulation by tubular handling tools and equipment, and resistant to damage by such tools. Such materials may include, for example, 120-150 ksi steel, or non-magnetic alloys. The same is true of the joint 46. These may have standard threaded connections to allow them to be joined to mating tubular sections at each end, and these additional mating sections may include standard conventional tubulars as well as similar modular tubular sections. Materials for the tubular section, on the other hand, might include 2000 or 7000 series aluminum, aluminum metal matrix composite alloy, titanium alloys, nickel alloys, stainless steels, and so forth. Typically these have properties that are highly desirable for certain lengths of the tubular string, but may be more susceptible to damage by conventional tubular handling tools.

It should also be noted that the system and technology disclosed creates a highly flexible and useful approach to utilizing alternative materials as tubulars in well applications. In particular, when the modular product utilizes a tubular section made of a desired material (e.g., aluminum alloy, titanium alloy, metal or other composite), the ends may be adapted to interface with this section, while the connections at either end of the overall modular section may be selected to permit easy attachment and integration with other tubular products. That is, the handling section may have an end connector that is different from the connection made to the tubular section, and at an opposite end, the end connector that is secured to the other end of the tubular section may also be different from its connection to the tubular section. For use, then tubular sections made of the alternative material may be stocked and utilized in combination with various ends (a handling section and an opposite end connector), which may be preformed, machined, and prepared, and stocked for combination with the tubular section in accordance with the connection interfacing requirements of a particular application. This may reduce the need for machining and stocking many different tubular sections while still allowing the resulting system to be readily adapted for tubular strings having different sizes, connections, and requirements.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A modular tubular method comprising:

pre-assembling a tool handling section comprising a single tubular member made of a first material for handling with conventional tubular handling tools and a tubular section made of a second material, different from the first material, and having lower density and modulus than the first material, the tubular section forming a majority portion of an overall length of a resulting modular tubular system;

storing the resulting tool handling system, pre-assembled as an assembled modular tubular product prior to assembly with other tubular sections during deployment in a well; and wherein the tool handling section comprises a box tool joint formed at one end of the tool handling section and comprising a female threaded end for connecting the modular tubular system to a mating tubular section, a service joint formed at an opposite end of the tool handling section and comprising a female threaded end that is connected to a male threaded end of the tubular section, and a neck section of reduced outer diameter as compared to the ends of the tool handling section, forming a handling tube for conventional tubular handling tools; and wherein the tubular section comprises approximately 80 to 90 percent of the overall length of the modular tubular system;

and further comprising threadingly joining the resulting modular tubular system with a tool string being deployed in the well while contacting only the tool handling section and not the tubular section with tubular handling tools.

2. The method of claim 1, wherein the box tool joint comprises a reduced inner diameter smaller than an inner diameter of a central handling tube of the tool handing section.

3. The method of claim 1, comprising a pin tool joint on an end of the tubular section opposite the tool handling section.

4. The method of claim 3, wherein the pin tool joint comprises a female threaded connection receiving a second male threaded end of the tubular section, and a male threaded end for connecting the modular tubular system to a second mating tubular section.

5. The method of claim 1, wherein the modular tubular system has a nominal length of approximately 360 to 540 inches.

6. The method of claim 1, wherein the handling section has a nominal length of approximately 25 to 100 inches.

7. The method of claim 1, wherein the tubular section occupies a portion of the overall length of the modular tubular section of between 290 and 470 inches.

8. A modular tubular method comprising:

pre-assembling a tool handling section comprising a single tubular member made of a first material for handling with conventional tubular handling tools and a tubular section made of a second material, different from the first material, and having lower density and modulus than the first material, the tubular section forming a majority portion of an overall length of a resulting modular tubular system;

storing the resulting tool handling system, pre-assembled as an assembled modular tubular product prior to assembly with other tubular sections during deployment in a well; and threadingly joining the resulting modular tubular system with a tool string being deployed in the well while contacting only the tool handling section and not the tubular section with tubular handling tools;

wherein the tool handling section comprises a box tool joint formed at one end of the tool handling section and comprising a female threaded end for connecting the modular tubular system to a mating tubular section, a service joint formed at an opposite end of the tool handling section and comprising a female threaded end that is connected to a male threaded end of the tubular section, and a neck section of reduced outer diameter as compared to the ends of the tool handling section, forming a handling tube for conventional tubular handling tools.

9. The method of claim 8, wherein the tool handling section is made of steel, and the tubular section is made of aluminum or titanium, or an aluminum or titanium alloy, or a composite material.

10. The method of claim 8, wherein the tubular section comprises approximately 80 to 90 percent of the overall length of the modular tubular system.

11. The method of claim 8, wherein the box tool joint comprises a reduced inner diameter smaller than an inner diameter of central handling tube of the tool handing section.

12. The method of claim 8, wherein the modular tubular system has a nominal length of approximately 360 to 540 inches.

13. The method of claim 12, wherein the handling section has a nominal length of approximately 25 to 100 inches.

14. The method of claim 8, wherein the tubular section occupies a portion of the overall length of the modular tubular section of between 290 and 470 inches.

15. A modular tubular assembly and deployment method comprising:

pre-assembling modular tubular product comprising a tool handling section comprising a single tubular member made of a first material for handling with conventional tubular handling tools, and a tubular section made of a second material, different from the first material, and having lower density and modulus than the first material, the tubular section forming a majority portion of an overall length of the pre-assembled modular tubular product;

storing the pre-assembled modular tubular product prior to assembly with other tubular sections during deployment in a well; and threadingly joining the stored pre-assembled modular tubular product with a tool string being deployed in the well while contacting only the tool handling section and not the tubular section with tubular handling tools;

wherein the tool handling section comprises a box tool joint formed at one end of the tool handling section and comprising a female threaded end for connecting the modular tubular assembly to a mating tubular section, a service joint formed at an opposite end of the tool handling section and comprising a female threaded end that is connected to a male threaded end of the tubular section, and a neck section of reduced outer diameter as compared to the ends of the tool handling section, forming a handling tube for conventional tubular handling tools.

16. The method of claim 15, wherein the tubular section of each modular tubular assembly comprises approximately 80 to 90 percent of the overall length of the modular tubular assembly.

17. The method of claim 15, wherein the box tool joint comprises a reduced inner diameter smaller than an inner diameter of central handling tube of the tool handing section.

* * * * *